US005785575A

United States Patent [19]

Llorens

[11] Patent Number: 5,785,575

[45] Date of Patent: Jul. 28, 1998

[54] DOLL WITH SIMULTANEOUS RAISING OF THE ARMS AND LEGS AND OPENING OF THE EYES

[75] Inventor: Ferri Jaime Llorens, Onil, Spain

[73] Assignee: Innovacion S.A., Alicante, Spain

[21] Appl. No.: 771,293

[22] Filed: Dec. 20, 1996

[51] Int. Cl.[6] ..... A63H 3/20; A63H 3/40; A63J 19/00

[52] U.S. Cl. ..... 446/340; 446/346; 446/365

[58] Field of Search ..... 446/340, 339, 446/337, 330, 341, 342, 343, 346, 352, 365, 379, 380, 390

[56] References Cited

U.S. PATENT DOCUMENTS

| | | | |
|---|---|---|---|
| 1,323,153 | 11/1919 | Calkins et al. | 446/339 |
| 2,641,866 | 6/1953 | Schiller | 446/337 X |
| 2,965,385 | 12/1960 | Ayala | 446/316 X |
| 3,021,641 | 2/1962 | Banks | 446/340 |
| 3,448,539 | 6/1969 | Hartpence | 446/370 X |
| 3,616,572 | 11/1971 | Kosicki et al. | 446/346 |
| 3,758,982 | 9/1973 | Lemelson et al. | 446/365 |
| 4,136,484 | 1/1979 | Abrams | 446/370 |
| 5,378,188 | 1/1995 | Clark | 446/365 X |

FOREIGN PATENT DOCUMENTS

| | | | |
|---|---|---|---|
| 352728 | 8/1905 | France | 446/356 |
| 805379 | 5/1951 | Germany | 446/341 |

*Primary Examiner*—Robert A. Hafer
*Assistant Examiner*—D. Neal Muir
*Attorney, Agent, or Firm*—Howell & Haferkamp, L.C.

[57] ABSTRACT

A doll which simultaneously raises its arms and legs and opens its eyes between whose arms an elastic element is attached which tends to keep the arms in a folded position over the front part; being special in that to each end of the elastic element are attached to extensible braces which are duly guided inside the doll's body, one of the other brace is associated to the leg on that same side, in such a manner that from the resting position the raising of one of the arms causes the simultaneous raising of the leg on that side and the opning of the ye on that same side, being liable to have one arm or the other or both arms raised at the same time.

3 Claims, 1 Drawing Sheet

DOLL WITH SIMULTANEOUS RAISING OF THE ARMS AND LEGS AND OPENING OF THE EYES

BACKGROUND OF THE INVENTION

The invention is related to a doll which simultaneously raises its arms and legs and opens its eyes in such a manner that said movements are performed by the doll from a lying-down or resting position whenever the child or user manually raises either arm of the doll.

SUMMARY OF THE INVENTION

Thus, the doll proposed is designed to offer new functions or effects in regard to movements not performed by any doll presently being marketed.

More specifically, the doll of the invention is formed of flexible material such as cloth, rubber or some other kind of adequate material and incorporates an elastic element—located either externally or internally at the height of the chest, in a transversal arrangement—at each end of which a pair of extensible braces is fixed which run internally, one of the braces in each pair being attached through its other end to a lower extremity, while the other brace is attached to an eye, specifically the eye on the same side as said extremity.

Thus, both ends of the elastic element being attached to the arms of the doll, each time one or both arms are extended or raised from the resting or folded-over-the-chest position, the braces are pulled on that side, thereby raising the corresponding lower extremity and opening the eye on that side, all this resulting from said attachment between the doll's elastic element, arms and braces and said attachment between the braces themselves and the eyes and lower extremities.

Evidently, and as previously stated, in the resting position the doll is lying-down with its arms folded forwards, its lower extremities extended and its eyes closed.

The system allowing for said movements requires that the doll's extremities be of a floating type.

Furthermore, the doll may optionally be fitted with a sounding device that functions through adequate means every time an arm is extended or raised, emitting characteristic sounds such as crying, laughter, a voice, etc.

BRIEF DESCRIPTION OF THE DRAWINGS

To complement the following description and in order to help toward a better understanding of the characteristics of the invention, a detailed description is provided based on a set of drawings attached to this specification and forming an integral part thereof, wherein the following is represented merely within an orientating, non-limiting character.

Figure 1:
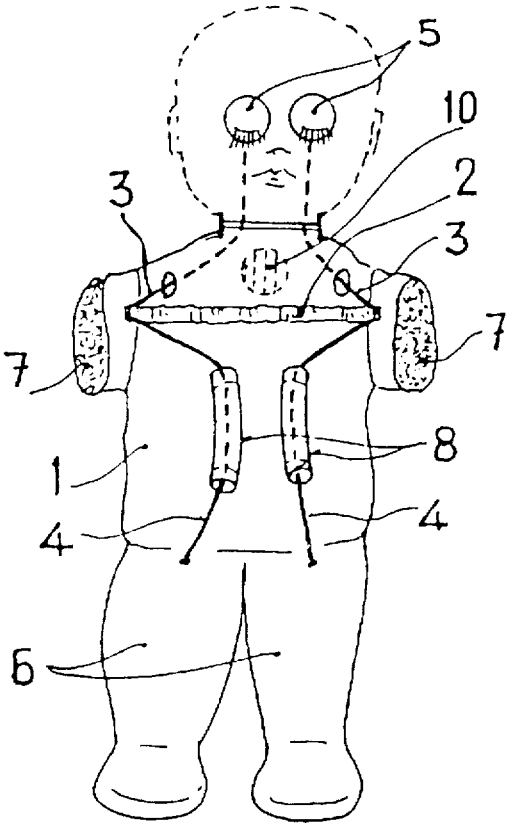
FIG. 1 shows a front view of the doll, the elastic means and the braces allowing for simultaneous movement of the arms, the legs and the eyes.
Figure 2:
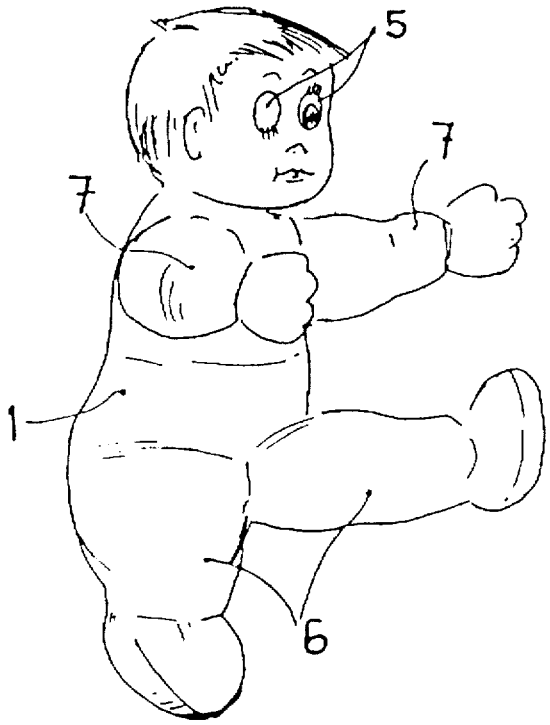
FIG. 2 shows a perspective view of the doll with an arm and the respective leg raised, and with the eye on that same side open.
Figure 3:
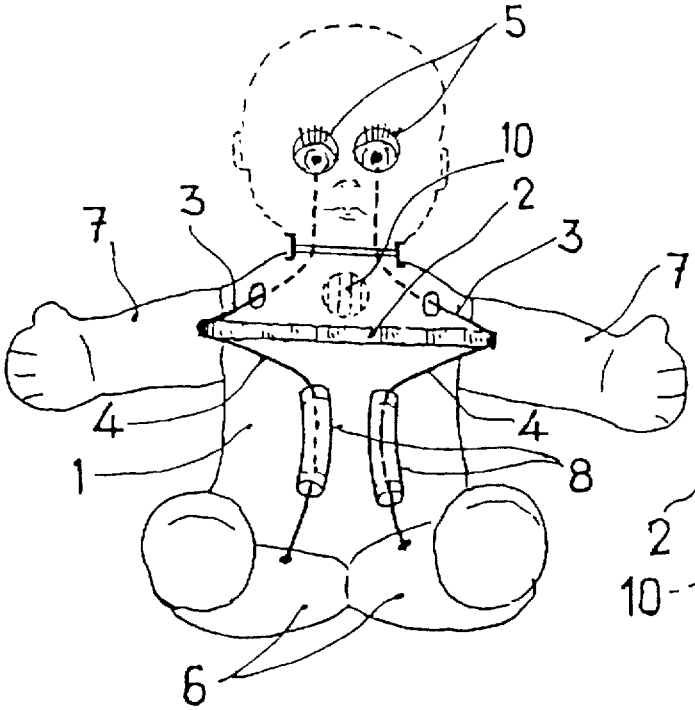
FIG. 3 shows the doll with its four extremities raised and both its eyes open.
Figure 4:
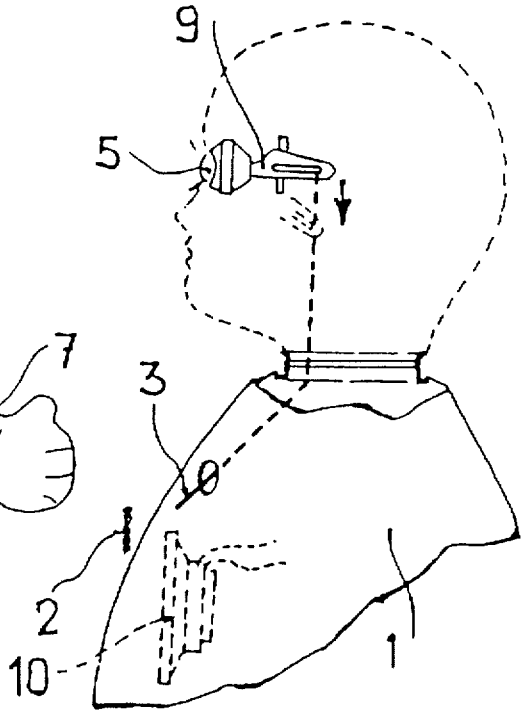
FIG. 4 shows in detail the manner in which each brace is attached to a respective eye of the doll.

In said figures, the following numerical references apply:

1—Doll.

2—Elastic element fixed between the arms (7).

3—Braces attached to the eyes (5).

4—Braces attached to the legs (6).

5—Eyes of the doll (1).

6—Legs of the doll (1).

7—Arms of the doll (1).

8—Brace (4) guiding macaroons.

9—Eye (5) supports.

10—Loudspeaker.

DESCRIPTION OF THE PREFERRED EMBODIMENTS

As can be seen from the above figures, the doll (1) of the invention is special in that its front part incorporates, at the height of the chest, a transversely oriented elastic element (2) which may run either externally, protected by the doll's (1) clothing, or hidden internally. In either case, to each end of said elastic element (2) are simultaneously attached two braces (3) and (4), the first being related to the respective eye (5) and the second to the respective leg or inferior extremity (6).

The ends of the elastic element (2) are in turn attached to the arms (7) of the doll, pulling on the arms to keep them on the front zone or portion, normally folded over the chest.

The braces (4) associated to the legs (6) run inside their respective guiding macaroons (8); the braces (3) are associated to the corresponding supports (9) for mounting the eyes (5).

In either case, the braces (3) and (4) are extensible and run in a suitably guided manner, so that whenever the doll is in a resting position and the child or user raises one of the doll's arms, simultaneous raising of the leg on that side and opening of the respective eye follows. Naturally, these movements may be conducted either separately or jointly, i.e. raising both arms at the same time.

As previously stated, the doll may be fitted with a sounding device capable of emitting, via a loudspeaker (10), a characteristic sound every time the arms are raised or extended, which action, as previously explained, is accompanied by the simultaneous raising of the legs and opening of the eyes.

What is claimed is:

1. A doll having a front, back, two sides and two arms, two legs and two eyes, wherein one arm, leg and eye is located on each of said sides, and which simultaneously raises its arms and legs and opens its eyes wherein that between the arms of the doll itself is attached an elastic element which tends to keep the arms in a folded resting position over the front; with a feature that to each end of said elastic element two extensible braces are attached which are duly guided inside the doll's body, one of said braces being associated to the eye on that side, while the other brace is associated to the leg on that same side, in such a manner that from said resting position the raising of one of the arms causes the simultaneous raising of the leg on that side and the opening of the eye on that same side, being liable to have one arm or the other or both arms raised at the same time.

2. A doll as set forth in claim 1 wherein the doll is formed of a flexible material.

3. A doll having a front, back, two sides and two arms, two legs and two eyes, wherein one arm, leg and eye is located on each of said sides, the doll comprising an elastic element extending between the arms from one end of the elastic member attached to the arm on one side of the doll to an opposite end of the elastic member attached to the arm on the other side of the doll, the elastic member biasing the arms to a folded position over the front, two pairs of extensible braces, one pair attached to each of the ends of the elastic member, one of the braces of each pair being operatively connected to the eye on the side on which the end is located, the other brace of each pair being operatively connected to the leg on the side on which that end is located, such that raising one of the arms from the folded position on either side of the doll causes simultaneous raising of the leg and opening of the eye on the same side of the doll, wherein either arm can be raised independently of the other or both arms can be raised simultaneously.

* * * * *